US009370872B2

(12) United States Patent
Chang

(10) Patent No.: US 9,370,872 B2
(45) Date of Patent: Jun. 21, 2016

(54) WOODWORKING LATHE ADJUSTMENT STRUCTURE

(71) Applicant: KINGSAND MACHINERY LTD., Taichung (TW)

(72) Inventor: Chin-Feng Chang, Taichung (TW)

(73) Assignee: KINGSAND MACHINERY LTD., Taichung (TW)

( * ) Notice: Subject to any disclaimer, the term of this patent is extended or adjusted under 35 U.S.C. 154(b) by 74 days.

(21) Appl. No.: 14/514,365

(22) Filed: Oct. 14, 2014

(65) Prior Publication Data

US 2016/0101538 A1 Apr. 14, 2016

(51) Int. Cl.

| | |
|---|---|
| ***B23B 21/00*** | (2006.01) |
| ***B27C 7/00*** | (2006.01) |
| *B23B 3/00* | (2006.01) |

(52) U.S. Cl.

CPC ..... *B27C 7/00* (2013.01)

(58) Field of Classification Search

CPC .. B23B 23/005; B23B 23/025; B23B 23/045; B23B 3/30; B23Q 5/42; B23Q 5/54; B27C 7/04

See application file for complete search history.

(56) References Cited

U.S. PATENT DOCUMENTS

| | | | | | |
|---|---|---|---|---|---|
| 419,155 | A * | 1/1890 | McDaniel | B23B 23/025 | 82/142 |
| 2,243,588 | A * | 5/1941 | Wahnish | B23B 23/005 | 82/148 |
| 2,414,861 | A * | 1/1947 | Evans | B23B 23/005 | 82/148 |
| 2,427,227 | A * | 9/1947 | Olds | B23B 23/005 | 82/148 |
| 4,995,434 | A * | 2/1991 | Christiansen | B27C 7/04 | 142/48 |
| 5,282,402 | A * | 2/1994 | Cady | B23B 23/00 | 82/117 |
| 7,281,460 | B2 * | 10/2007 | Smith | B23B 23/005 | 82/148 |

* cited by examiner

*Primary Examiner* — Will Fridie, Jr.
(74) *Attorney, Agent, or Firm* — David and Raymond Patent Fir; Raymond Chan

(57) ABSTRACT

A woodworking lathe adjustment structure includes a base having an axial slide trough thereon, a head unit and a tail unit disposed on the base. An adjustment block is provided between the head unit/the tail unit and the slide trough. The adjustment block includes a groove, a space adjustment bolt, and an adjustment bolt. The groove has a compelling hole therein. The compelling hole has a threaded section and a non-threaded section therein. The space adjustment bolt is screwed to the threaded section. The adjustment block is secured to the bottom of the head unit/the tail unit by fixing bolts, respectively, and inserted in the slide trough. When the space adjustment bolt passes the non-threaded section of the compelling hole, the sides of the groove will be deformed outward and curvedly to offset a gap which is caused by wear and tear of the adjustment block and the slide trough.

6 Claims, 8 Drawing Sheets

WOODWORKING LATHE ADJUSTMENT STRUCTURE

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

1. Field of Invention

The present invention relates to a woodworking lathe adjustment structure, and more particularly to a woodworking lathe adjustment structure able to offset the gap between a head unit/a tail unit and a slide trough and to adjust the central axis of the head and tail units to enhance the accuracy of woodworking process.

2. Description of Related Arts

As shown in FIG. 1 and FIG. 2, a conventional woodworking lathe comprises a machine 1. The machine 1 comprises a base 2 having an axial dovetail trough 3, a heat unit 4 and a tail unit 5 disposed on the base 2. The bottoms of the head unit 4 and the tail unit 5 each have an integral protrusion 6, 7. The protrusions 6, 7 are inserted from two sides of the dovetail trough 3 to be moveable along the dovetail trough 3 on the base 2. When processed, the wood is placed between the head unit 4 and the tail unit 5 and the distance between the head unit 4 and the tail unit 5 is adjusted for the wood to be clamped between the head unit 4 and the tail unit 5. The aforesaid structure has the following shortcomings.

1. When the distance between the head unit 4 and the tail unit 5 is adjusted, the protrusions 6, 7 are moved along the dovetail trough 3 to suffer a lot of wear and tear after a long time. The contact surfaces of the dovetail trough 3 and the protrusions 6, 7 are gradually worn to cause a gap L1, as shown in FIG. 2, which results in that the protrusions 6, 7 will shake in the dovetail trough 3 to make noises and deviation of the central axis to influence the accuracy of woodworking process.

2. If the contact surfaces of the dovetail trough 3 and the protrusions 6, 7 are worn to become uneven, the central axis of the heat unit 4 and the tail unit 5 will bring an angle change (angle of elevation or angle of depression). This results in that the head and tail units are not coaxial to cause an error when the wood is processed so the accuracy is not good.

3. If the dovetail trough 3 and the protrusions 6, 7 suffer a lot of wear and tear, the entire machine 1 must be replaced. This way increases the cost.

Accordingly, the inventor of the present invention has devoted himself based on his many years of practical experiences to solve these problems.

SUMMARY OF THE PRESENT INVENTION

The primary object of the present invention is to provide a woodworking lathe adjustment structure to overcome the shortcomings of the prior art.

In order to achieve the aforesaid objective, the woodworking lathe adjustment structure of the present invention comprises a base having an axial slide trough thereon, a head unit and a tail unit disposed on the base. An adjustment block is provided between the head unit/the tail unit and the slide trough. Two sides of the adjustment block have grooves. The grooves each have a compelling hole therein. The compelling hole is provided with a space adjustment bolt therein. Through the space adjustment bolt to pass the compelling hole, a corresponding one of the grooves is deformed outward and curvedly to offset a gap which is caused by wear and tear of the adjustment block and the slide trough.

Preferably, the two sides of the adjustment block are provided with adjustment bolts. Through the adjustment bolts to hold against the bottom of the head unit as well as the tail unit, the angle of the central axis of the head unit and the tail unit can be adjusted for accuracy.

DETAILED DESCRIPTION OF THE PREFERRED EMBODIMENT

Figure 1:
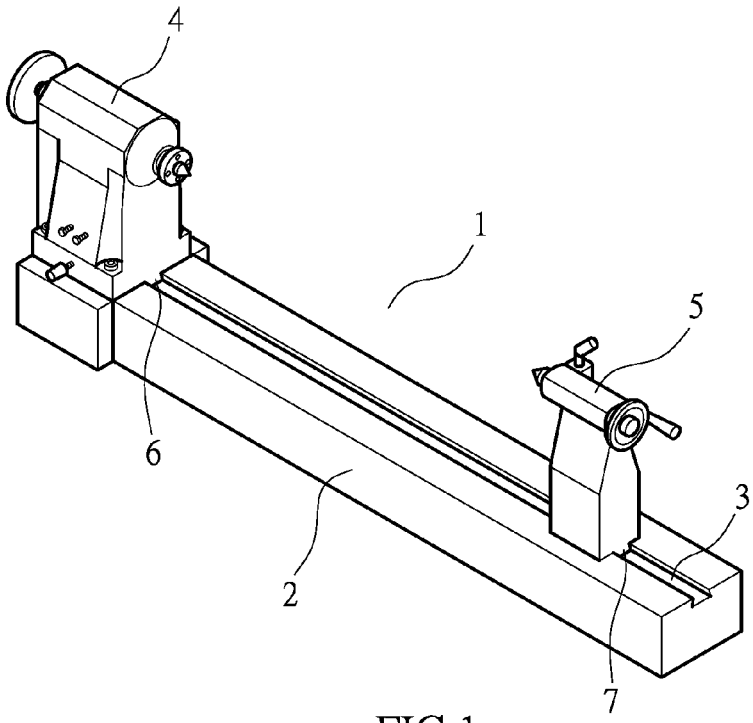
FIG. 1 is a perspective view of a conventional woodworking lathe.
Figure 2:
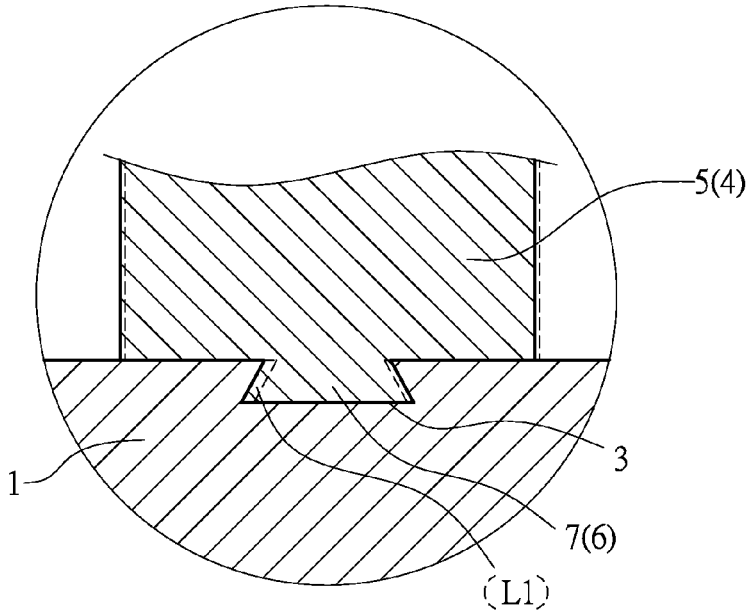
FIG. 2 is a sectional view showing engagement of the dovetail trough and the protrusion.
Figure 3:
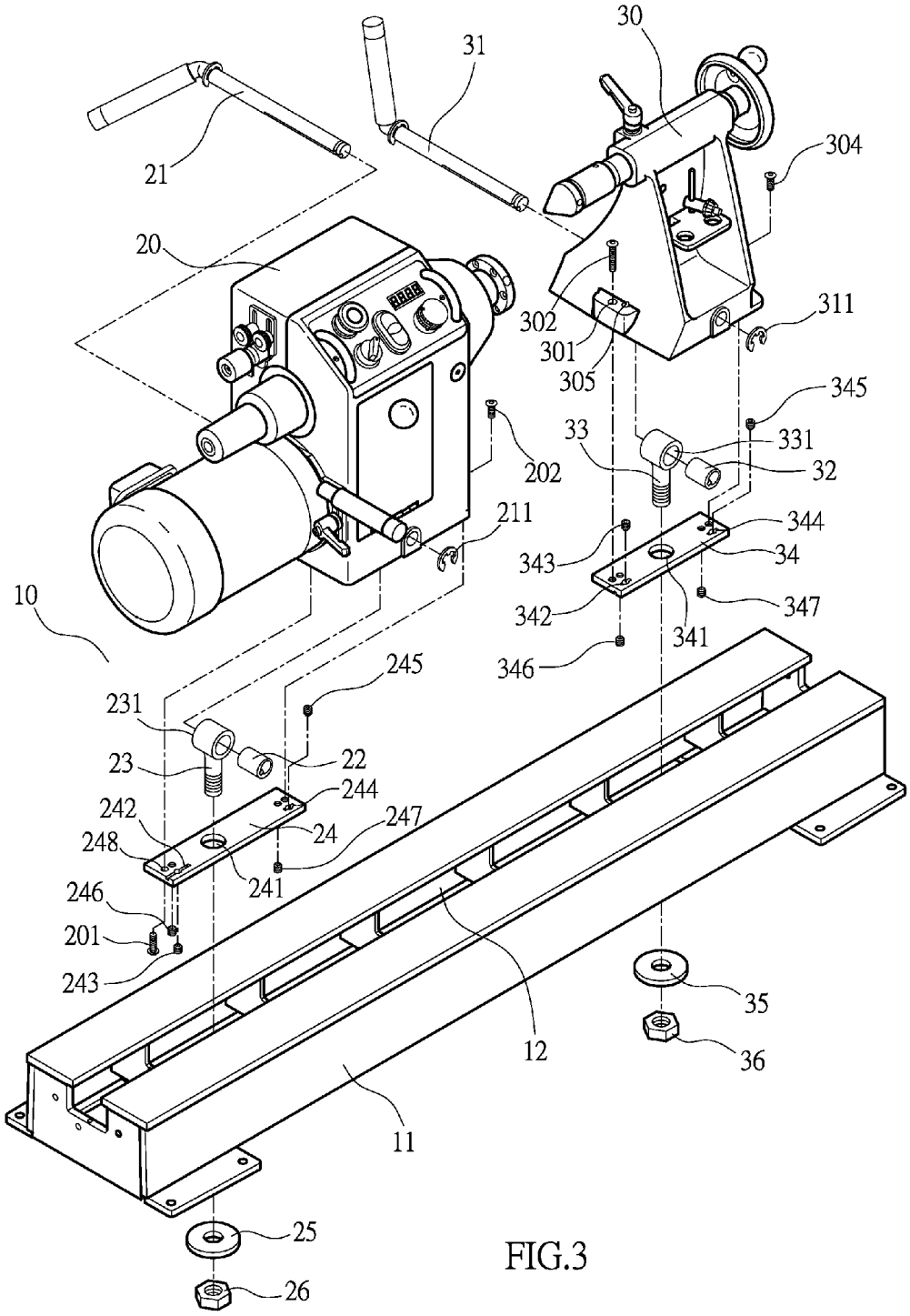
FIG. 3 is an exploded view according to a preferred embodiment of the present invention.
Figure 4:
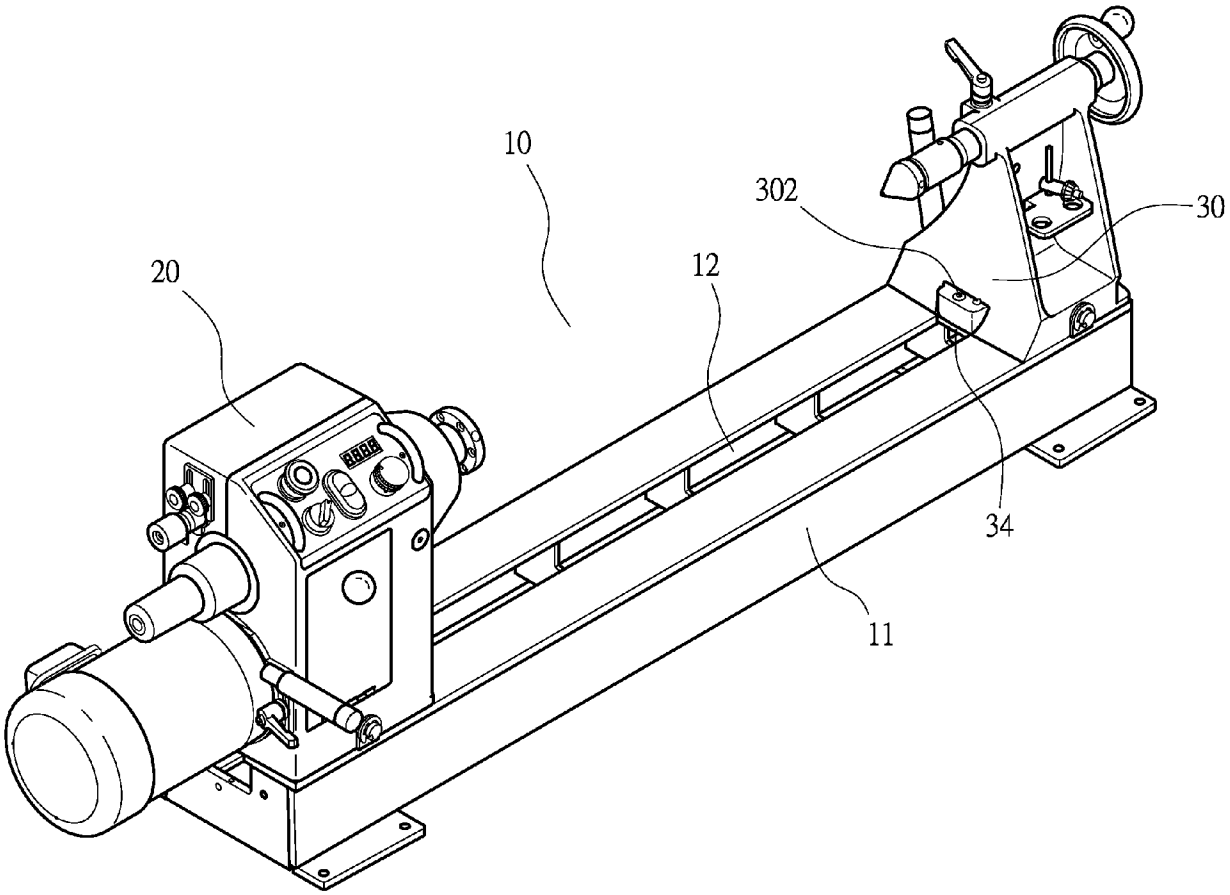
FIG. 4 is a perspective view according to the preferred embodiment of the present invention.
Figure 5:
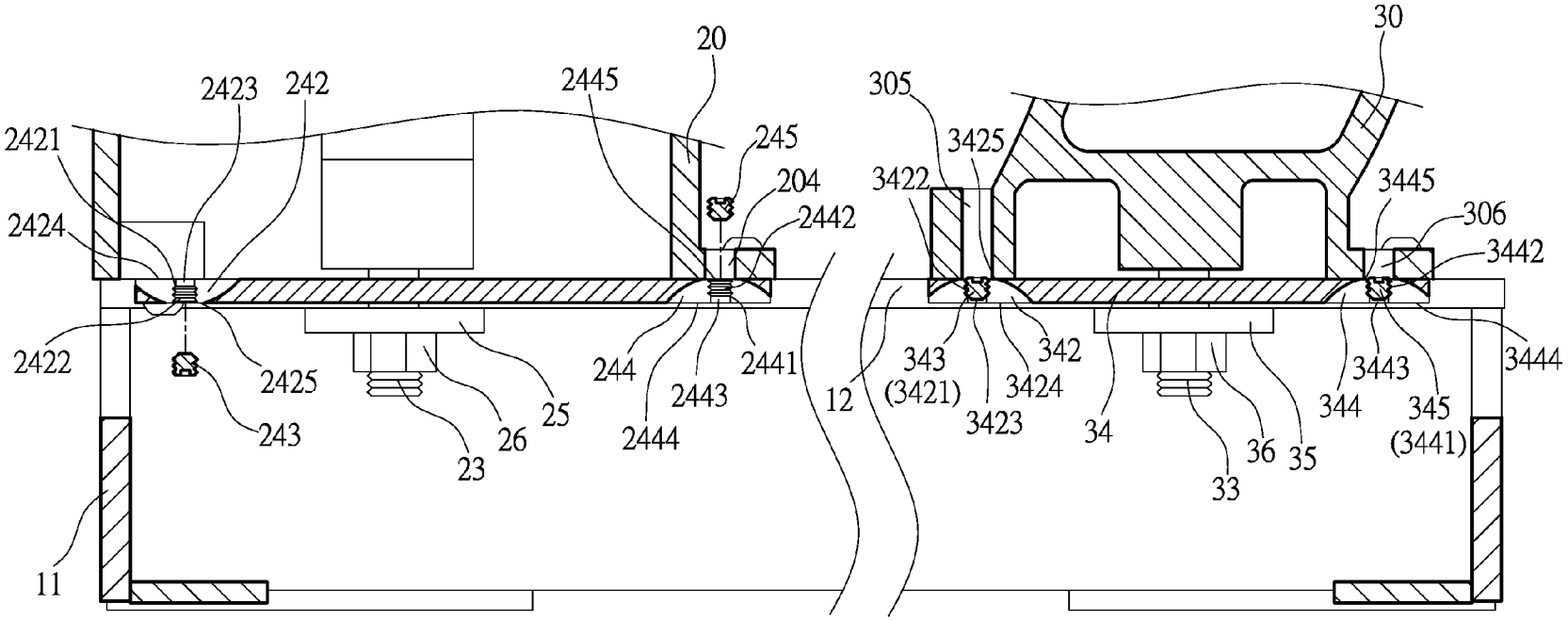
FIG. 5 is a side sectional view showing the grooves according to the preferred embodiment of the present invention.
Figure 6:
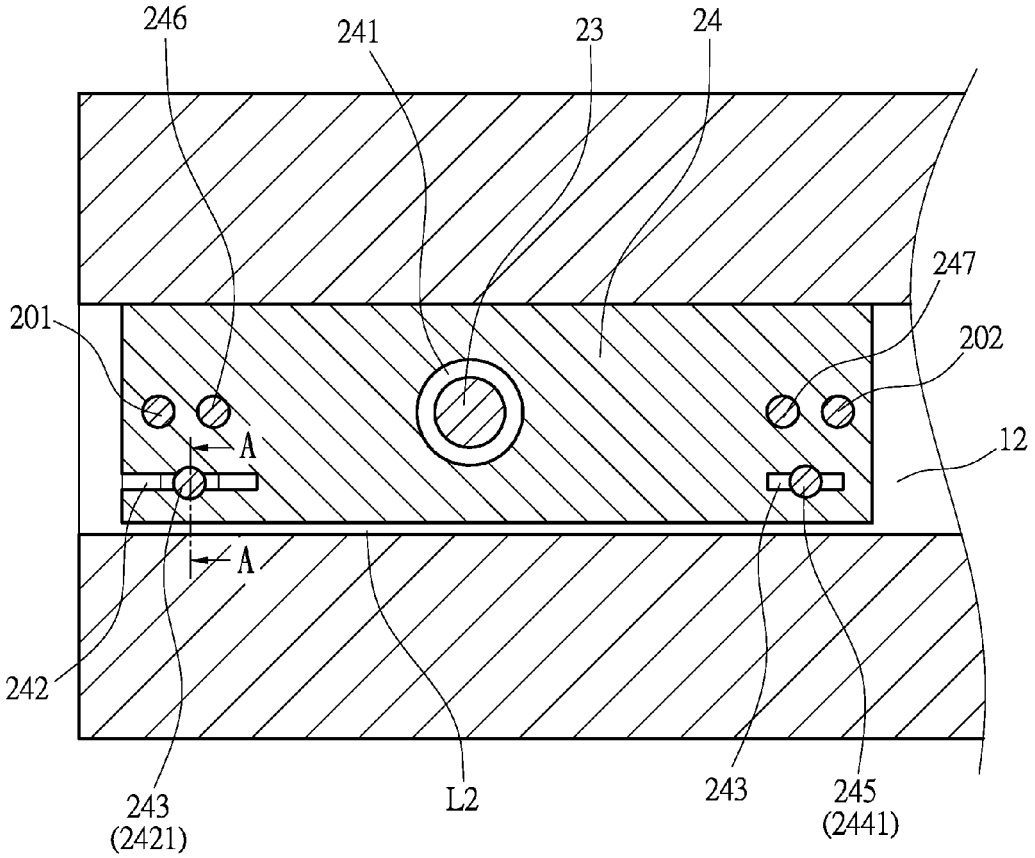
FIG. 6 is a top sectional view showing the gap between the adjustment block and the slide trough according to the preferred embodiment of the present invention.
Figure 7:
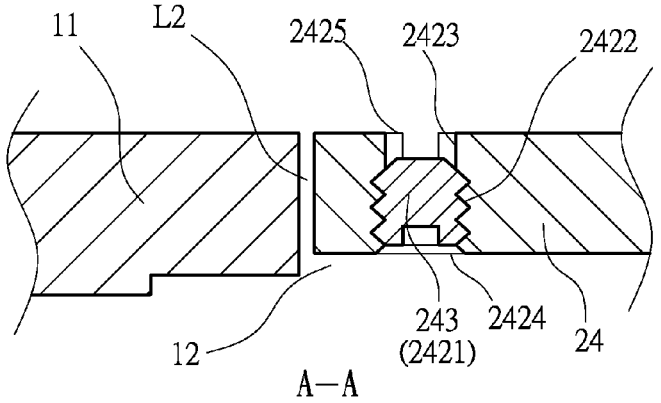
FIG. 7 is a sectional view taken along line A-A of FIG. 6.
Figure 8:
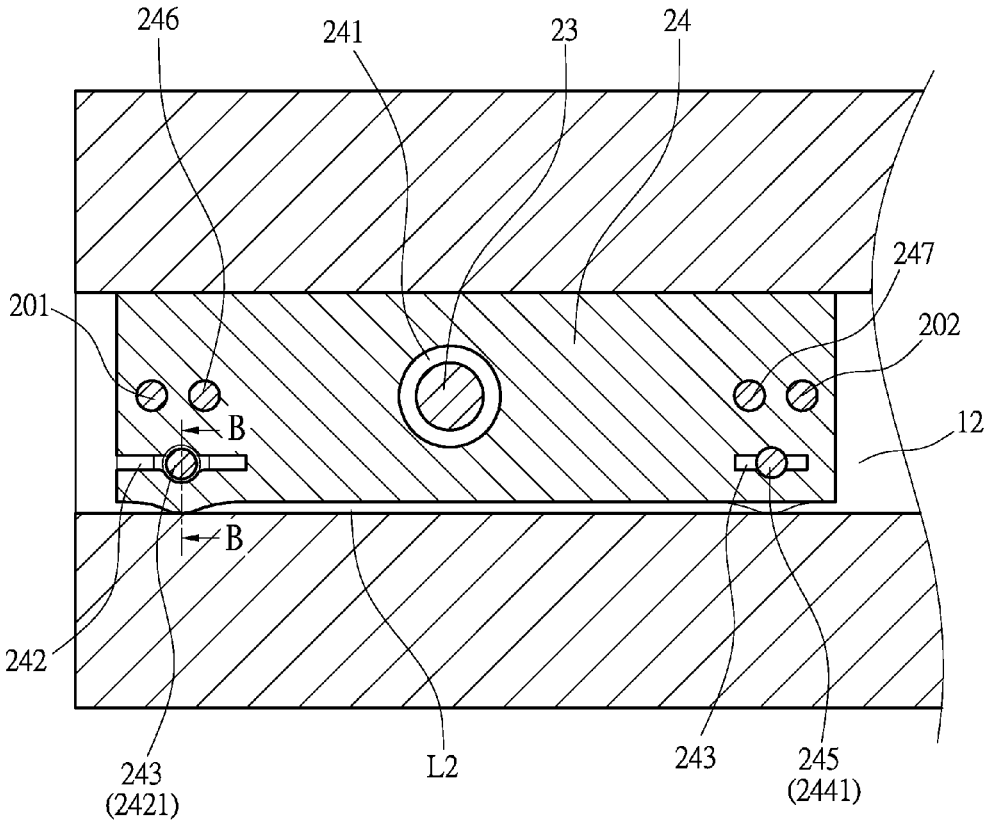
FIG. 8 is a top sectional view showing that the adjustment block is adjusted relative to the slide trough to offset the gap according to the preferred embodiment of the present invention.
Figure 9:
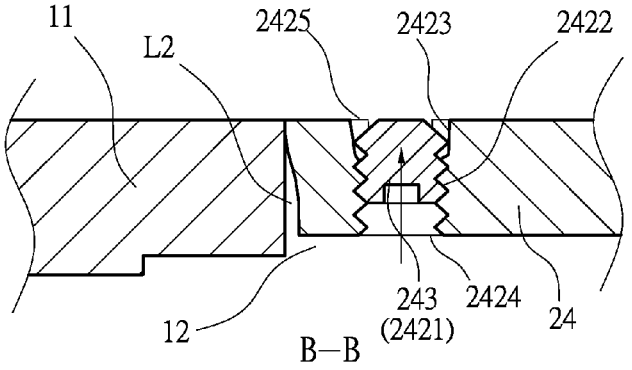
FIG. 9 is a sectional view taken along line B-B of FIG. 8.

Embodiments of the present invention will now be described, by way of example only, with reference to the accompanying drawings.

Referring to FIGS. 3, 4, 5, 6, 10, the present invention comprises a machine 10. The machine 10 comprises a base 11 having an axial slide trough 12 thereon. A head unit 20 and a tail unit 30 are disposed on the base 11. The head unit 20 and the tail unit 30 are movable along the rail trough 12 of the base 11. An adjustment block 24, 34 is provided between the head unit 20/the tail unit 30 and the slide trough 12. Two sides of the adjustment block 24, 34 have grooves 242, 244, 342, 344, respectively. Each of the grooves 242, 244, 342, 344 has a compelling hole 2421, 2441, 3421, 3441 therein. The compelling hole 2421, 2441, 3421, 3441 has a threaded section 2422, 2442, 3422, 3442 and a non-threaded section 2423, 2443, 3423, 3443 therein. The compelling hole 2421, 2441, 3421, 3441 is provided with a space adjustment bolt 243, 245, 343, 345 therein. The space adjustment bolt 243, 245, 343, 345 is screwed to the threaded section 2422, 2442, 3422, 3442. The two sides of the adjustment block 24, 34 are secured to the bottom of the head unit 20/the tail unit 30 by fixing bolts 201, 202, 302, 303, respectively, and inserted in the slide trough 12. Two sides of another cross-section of the adjustment block 24, 34 are provided with adjustment bolts 246, 247, 346, 347, respectively. The adjustment bolts 246, 247, 346, 347 hold against the bottom of the head unit 20/the tail unit 30, respectively.

Through the aforesaid structure, when the space adjustment bolt 243, 245, 343, 345 passes the non-threaded section 2423, 2443, 3423, 3443 of the compelling hole 2421, 2441, 3421, 3441, the grooves 242, 244, 342, 344 will be deformed outward and curvedly to offset a gap L2 which is caused by wear and tear of the adjustment block 24, 34 and the slide trough 12. Besides, through the adjustment bolts 246, 247, 346, 347 to hold against the bottom of the head unit 20/the tail unit 30, respectively, the corresponding axial angles of the head unit 20 and the tail unit 30 can be adjusted to ensure the head unit 20 and the tail unit 30 to be coaxial.

The assembly of the present invention is described hereinafter. Referring to FIGS. 3, 4, 5, 6, 10, the interior of the head unit 20 of the present invention is provided with a link shaft 23 having outer threads. The top end of the link shaft 23 is provided with a ring 231 to receive an eccentric shaft sleeve 22 therein. A lock lever 21 is inserted through the bottom of the head unit 20 and the eccentric shaft sleeve 22, and then one end of the lock lever 21 is locked by a buckle 211. The center of the adjustment block 24 has a through hole 241 for the link shaft 23 to pass therethrough without contact. One side of the adjustment block 24 is secured to the bottom of the head unit 20 by the fixing bolt 201 which is inserted from bottom to top through an aperture 248 of the adjustment block 24. The fixing bolt 202 at the other side is inserted from top to bottom through an aperture 203 to be locked on the adjustment block 24. After that, the head unit 20 and the adjustment block 24 are embedded in the slide rail 12. The width of the adjustment block 24 is equal to the width of the slide trough 12. The link shaft 23 is inserted in the slide trough 12, a tightening block 25 is fitted on the link shaft 23, and the link shaft 23 is locked to the bottom of the slide trough 12 with a screw nut 26. The width of the tightening block 25 is greater than that of the slide trough 12. At this time, the lock lever 21 is in a loosening state. Finally, the lock lever 21 is turned to bring the eccentric shaft sleeve 22 to turn the link shaft 23, such that the head unit 20 is tightly secured on the base 11. Similarly, the interior of the tail unit 30 is provided with a link shaft 33 having outer threads. The top end of the link shaft 33 is provided with a ring 331 to receive an eccentric shaft sleeve 32 therein. A lock lever 31 is inserted through the bottom of the tail unit 30 and the eccentric shaft sleeve 32, and then one end of the lock lever 31 is locked by a buckle 311. The center of the adjustment block 34 has a through hole 341 for the link shaft 33 to pass therethrough without contact. The fixing bolt 302 at one side of the adjustment block 34 is inserted from top to bottom through an aperture 301 of the tail unit 30 to be locked on the adjustment block 34. The fixing bolt 304 at the other side of the adjustment block 34 is inserted from top to bottom through an aperture 303 of the tail unit 30 to be locked on the adjustment block 34. After that, the tail unit 30 and the adjustment block 34 are embedded in the slide rail 12. The width of the adjustment block 34 is equal to the width of the slide trough 12. The link shaft 33 is inserted in the slide trough 12, a tightening block 35 is fitted on the link shaft 33, and the link shaft 33 is locked to the bottom of the slide trough 12 with a screw nut 36. The width of the tightening block 35 is greater than that of the slide trough 12. At this time, the lock lever 31 is in a loosening state. Finally, the lock lever 31 is turned to bring the eccentric shaft sleeve 32 to turn the link shaft 33, such that the tail unit 30 is tightly secured on the base 11. The present invention can be assembled easily, and it is convenient to make a replacement of the parts.

Referring to FIGS. 5, 6, 7, 8, 9, when the adjustment blocks 24, 34 of the head unit 20 and the tail unit 30 suffer a lot of wear and tear to generate a gap L2, the space adjustment bolt 243 in the compelling hole 2421 of the groove 242 is turned from the bottom of the base 11 to move forward toward the non-threaded section 2423. Because the proportion of the threaded section 2422 in the compelling hole 2421 is greater than that of the non-threaded section 2423, the advancing force is greater than the resistance. The groove 242 is an arc groove to form a big opening 2424 at one side thereof and a small opening 2425 at another side thereof. The non-threaded section 2423 and the big opening 2424 are disposed at the same side. Thus, the groove 242 where the big opening 2424 is located is thinner, so it is easy to be deformed. When the space adjustment bolt 243 passes the non-threaded section 2423, the hole of the non-threaded section 2423 will be deformed outward so that the sides of the groove 242 are deformed outward and curvedly. Through an aperture 204 of the head unit 20, the space adjustment bolt 245 in the compelling hole 2441 of the groove 244 is turned to move forward toward the non-threaded section 2443. Because the proportion of the threaded section 2442 in the compelling hole 2441 is greater than that of the non-threaded section 2443, the advancing force is greater than the resistance. The groove 244 is an arc groove to form a big opening 2444 at one side thereof and a small opening 2445 at another side thereof. The non-threaded section 2443 and the big opening 2444 are disposed at the same side. Thus, the groove 244 where the big opening 2444 is located is thinner, so it is easy to be deformed. When the space adjustment bolt 245 passes the non-threaded section 2443, the hole of the non-threaded section 2443 will be deformed outward so that the sides of the groove 244 are deformed outward and curvedly. The width of the adjustment block 24 is offset for the gap L2. Similarly, through an aperture 305 of the tail unit 30, the space adjustment bolt 343 in the compelling hole 3421 of the groove 342 is turned to move forward toward the non-threaded section 3423. Because the groove 342 is an arc groove, when the space adjustment bolt 343 passes the non-threaded section 3423, the sides of the groove 342 will be deformed outward and curvedly. Through an aperture 306 of the tail unit 30, the space adjustment bolt 345 in the compelling hole 3441 of the groove 344 is turned to move forward toward the non-threaded section 3443. Because the groove 344 is an arc groove, when the space adjustment bolt 345 passes the non-threaded section 3443, the sides of the groove 344 will be deformed outward and curvedly. The width of the adjustment block 34 is offset for the gap L2.

Figure 10:
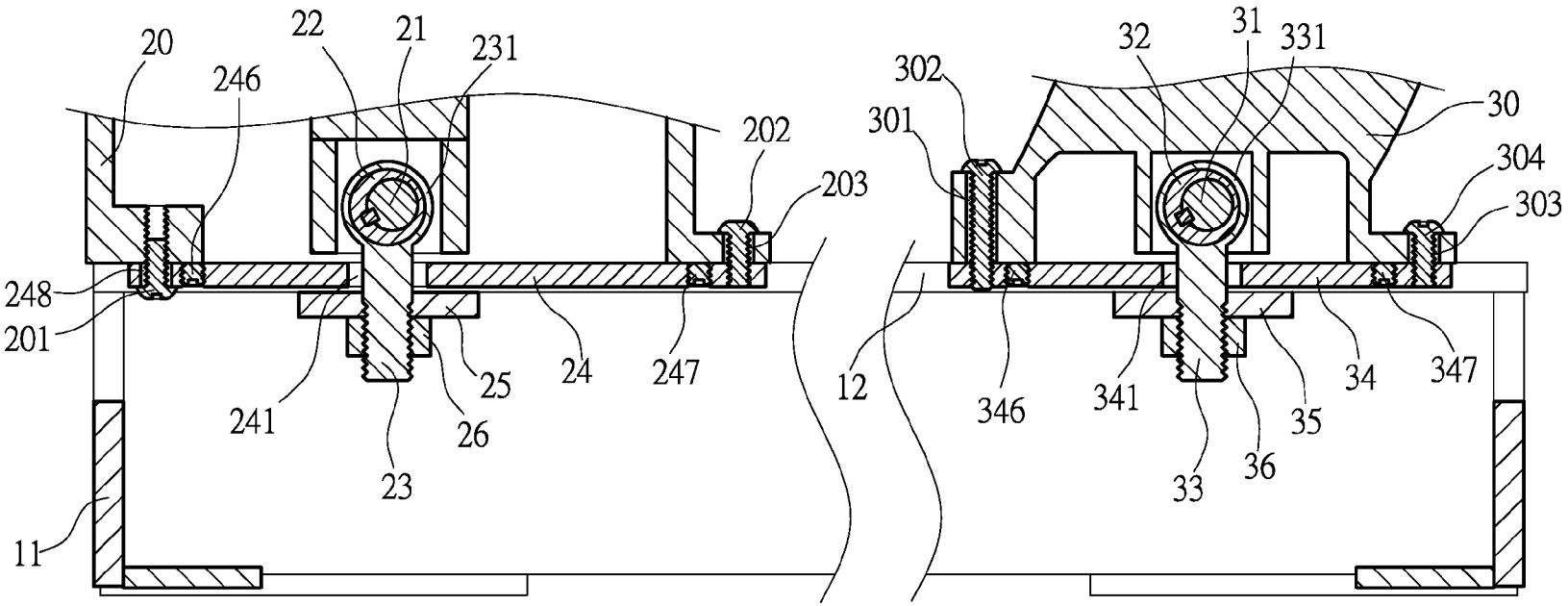
FIG. 10 is a side sectional view showing the adjustment bolts according to the preferred embodiment of the present invention.
Figure 11:
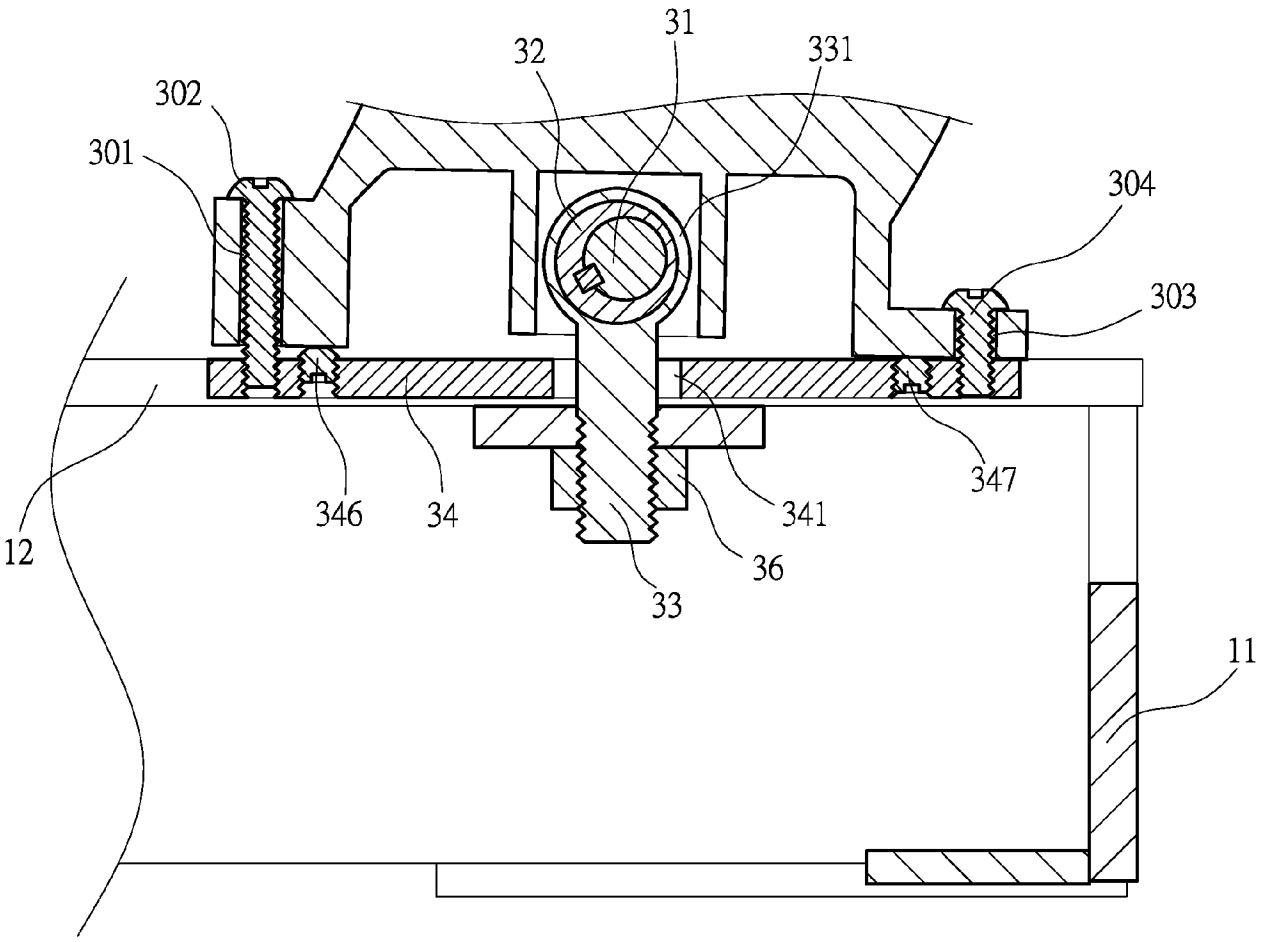
FIG. 11 is a schematic view showing that the tail unit is adjusted according to the preferred embodiment of the present invention.

Referring to FIG. 10 and FIG. 11, when the head unit 20 and the tail unit 30 suffer a lot of wear and tear to be uneven and the central axis is deviated, the fixing bolts 201, 202 of the head unit 20 are loosened and the adjustment bolts 246, 247 at the two sides of the adjustment block 24 are turned to hold against the bottom of the head unit 20 to bring a level angle change so as to adjust the angle of the central axis. After the orientation is completed, the fixing bolts 201, 202 are locked again. After that, the fixing bolts 302, 304 of the tail unit 30 are loosened and the adjustment bolts 346, 347 at the two sides of the adjustment block 34 are turned to hold against the bottom of the tail unit 20 to bring a level angle change so as to adjust the angle of the central axis. After the orientation is completed, the fixing bolts 302, 304 are locked again. The present invention can enhance the accuracy of woodworking process.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A woodworking lathe adjustment structure, comprising a machine, the machine comprising a base having an axial slide trough thereon, a head unit and a tail unit disposed on the base, the head unit and the tail unit being movable along the rail trough of the base; characterized by:

an adjustment block being provided between the head unit/the tail unit and the slide trough, two sides of the adjustment block having grooves, the grooves each having a compelling hole therein, the compelling hole having a threaded section and a non-threaded section therein, the compelling hole being provided with a space adjustment bolt therein, the space adjustment bolt being screwed to the threaded section, the adjustment block being secured to a bottom of the head unit as well as the tail unit by fixing bolts, respectively, and inserted in the slide trough;

wherein, when the space adjustment bolt passes the non-threaded section of the compelling hole, a corresponding one of the grooves is deformed outward and curvedly to offset a gap which is caused by wear and tear of the adjustment block and the slide trough.

2. The woodworking lathe adjustment structure as claimed in claim 1, wherein each of the grooves is an arc groove to form a big opening at one side thereof and a small opening at another side thereof, the non-threaded section and the big opening being disposed at the same side.

3. The woodworking lathe adjustment structure as claimed in claim 1, wherein the proportion of the threaded section is greater than that of the non-threaded section.

4. The woodworking lathe adjustment structure as claimed in claim 1, wherein the two sides of the adjustment block are provided with adjustment bolts, the adjustment bolts holding against the bottom of the head unit as well as the tail unit.

5. The woodworking lathe adjustment structure as claimed in claim 2, wherein the two sides of the adjustment block are provided with adjustment bolts, the adjustment bolts holding against the bottom of the head unit as well as the tail unit.

6. The woodworking lathe adjustment structure as claimed in claim 3, wherein the two sides of the adjustment block are provided with adjustment bolts, the adjustment bolts holding against the bottom of the head unit as well as the tail unit.

* * * * *